United States Patent [19]

Montgomery et al.

[11] Patent Number: 5,070,799

[45] Date of Patent: Dec. 10, 1991

[54] SEWING MACHINE WITH ZIPPER CUTTER

[75] Inventors: Richard L. Montgomery, Maplewood; James E. Striff, St. Marys, both of Ohio

[73] Assignee: Findlay Industries, Botkins, Ohio

[21] Appl. No.: 639,204

[22] Filed: Jan. 9, 1991

[51] Int. Cl.[5] ..... D05B 3/12; D05B 37/06

[52] U.S. Cl. ..... 112/104; 112/130; 112/121.27; 112/265.2; 83/DIG. 1

[58] Field of Search ..... 112/130, 265.2, 104, 112/121.27, 129, 152, 307, 265.1, 163, 113, 136, 147; 83/937, DIG. 1, 478

[56] References Cited

U.S. PATENT DOCUMENTS

| | | | |
|---|---|---|---|
| 2,483,138 | 9/1949 | Helmer | 112/121.11 |
| 3,329,113 | 7/1967 | Lewis et al. | 112/130 |
| 3,570,434 | 3/1971 | Gustavsson | 112/265.2 |
| 3,938,454 | 2/1976 | Boser | 112/130 |
| 4,018,464 | 5/1991 | Hampel et al. | 112/130 |
| 4,169,421 | 10/1979 | Foults | 112/104 |
| 4,441,438 | 4/1984 | Takahashi | 112/130 X |
| 4,625,604 | 12/1986 | Handler et al. | 83/DIG. 1 X |
| 4,674,422 | 6/1987 | Boser | 112/121.27 |
| 4,704,781 | 11/1987 | Frohlich | 112/265.1 X |
| 4,714,038 | 12/1987 | Boser | 112/265.2 |
| 4,813,361 | 3/1989 | Yunoki | 112/104 |
| 4,854,253 | 8/1989 | Yunoki | 112/265.2 |
| 4,996,933 | 3/1991 | Boser | 112/265.2 |

*Primary Examiner*—Peter Nerbun

*Attorney, Agent, or Firm*—Sidney W. Millard

[57] ABSTRACT

A sewing machine sews a continuous zipper chain to two fabric side pieces. An adjacent severing device severs the sewn article into discrete units of a length selected by the operator. Operator observation of the severing device and sewn article is achieved by a mirror mounted between the sewing machine and the severing device.

12 Claims, 5 Drawing Sheets

FIG. 5
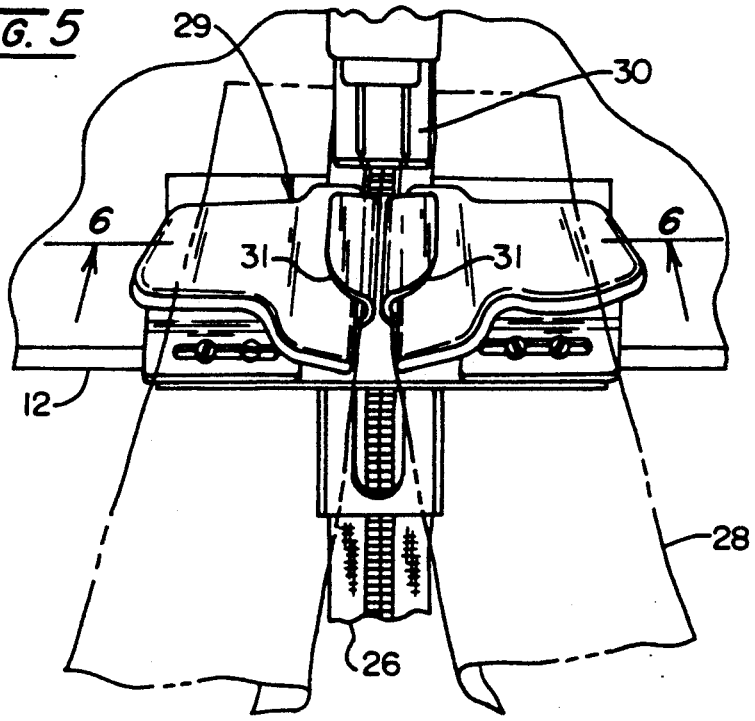
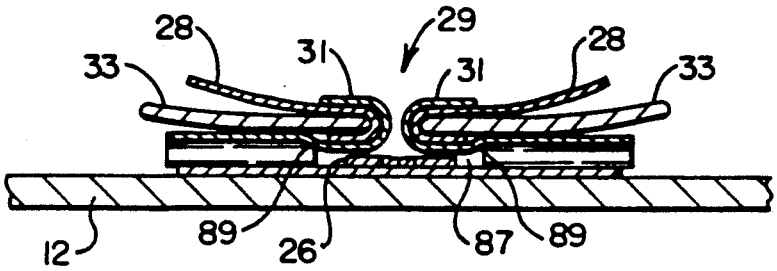
FIG. 6

SEWING MACHINE WITH ZIPPER CUTTER

FIELD OF THE INVENTION

This invention relates to the combination of a sewing machine to sew a zipper chain to two pieces of side fabric with the zipper chain in a continuous line and then severing the sewn portions into discrete units of a length selected by the operator.

BACKGROUND OF THE INVENTION

U.S. Pat. No. 2,483,138 discloses providing a cutter in the form of a stationary and cooperating movable sheer blade situated immediately behind the position of a needle bar of a sewing machine or its presser foot and providing a manual or pedal actuator by means of which the operator can sever the continuous chain of sewn goods.

U.S. Pat. No. 3,570,434 discloses a method and apparatus for simultaneously sewing two halves of a sliding clasp fastener forming part of a continuous fastener tape, with the fastener-coupling members on each half in engagement with each other, to a support such as the top material of a garment. The fastener tape with the desired length of both halves sewn onto the support is severed in a part that is provisionally left disconnected from the support, and the tape is provided simultaneously with a connection to join together the interengaging coupling members on the two halves in the region of the severing.

U.S. Pat. No. 3,938,454 discloses a combination of a sewing machine and a cutting device consisting of a reciprocating blade located in a safe position below the machine work surface, and a descending operative member which urges the material to be cut into cutting relation with said blade. Cutting action is thus achieved without impact (as occurs with a guillotine cutter) and, most important, in a selected width that corresponds to the width of said descending operative member.

U.S. Pat. No. 4,169,421 discloses an attachment for a sewing machine driven by a needle bar and includes a knife which engages and feeds in step-by-step fashion the fastener ladder through the machine as the machine stitches it to the fabric. Means on the attachment are provided to selectively drive the knife into deeper engagement with the ladder to sever the ladder at the end of slide fastener.

U.S. Pat. No. 4,674,422 discloses a method of sewing and an automatic sewing apparatus for accurately aligning fabric pieces and continuously fed zipper chain at a sewing station and sequentially thereafter sewing the chain into the fabric in zipper-closed condition, cutting the chain to a length determined by the length of the fabric, cutting the sewing thread upon completion of the sewing operation and stacking the assembled fabric and zipper combination for subsequent removal.

U.S. Pat. No. 4,704,781 discloses a process and apparatus for mounting a slide fastener segment near the opposing edges of two pieces of material, particularly on a slit in a piece of clothing, a slide fastener strip, the slide fastener segment or the slide fastener and the pieces of material are fed to the sewing stations of a two needle sewing machine. The pieces of material in the region between the sewing stations are positioned to form a gap and are curved so that a portion of each hangs substantially vertically from two fold edges or creases in an intervening space between both of the sewing stations. Both slide fastener halves of the open slide fastener segment or the open slide fastener are sewn on from above on the horizontal portion of the pieces of the material along the fold edges.

U.S. Pat. No. 4,714,038 discloses a method of sewing and an automatic sewing apparatus for accurately aligning fabric pieces and continuously fed zipper chain at a sewing station and sequentially thereafter sewing the chain into the fabric in zipper-closed condition, cutting the chain to a length determined by the length of the fabric, cutting the sewing thread upon completion of the sewing operation and stacking the assembled fabric and zipper combination for subsequent removal.

U.S. Pat. No. 4,813,361 discloses a method and apparatus for applying a protective strip by sewing to an end of a slide fastener, a continuous protective strip which is fed downwardly toward a tape supply position on the base of a sewing machine with its one surface facing opposite to a direction of feed of a slide fastener until a leading end portion of the protective tape overlays the base by a predetermined length. Then the leading end portion of the tape is bent in a direction opposite to the fastener feed direction by a stream of pressurized air issuing from an air nozzle. Thereafter, a slide fastener is advanced along the base until its leading end reaches to a sewing position located downstream of the tape supply position, thereby causing the leading end portion of the protective tape to bend into a U-shape extending from the back to the face of the slide fastener around the leading end thereof. Then the U-shaped leading end portion is cut from the continuous protective tape, thereby forming a U-shaped protective strip which in turn is sewn to the leading end of the slide fastener.

SUMMARY OF THE INVENTION

This invention relates to the combination of a sewing machine for sewing a zipper to side fabric and then severing the sewn material into discrete units for subsequent use.

The sewing machine includes a base which is mounted on a substrate with the operator of the apparatus to be seated on one side of the substrate. The severing device is mounted on the same substrate on the side of the sewing machine opposite to that of the operator.

An endless zipper chain is fed to the sewing machine through a guide which is mounted upstream of dual needle means for sewing the chain to two pieces of parallel side fabric. The guide includes a pair of U-shaped elements above a zipper guiding slot and their purpose is to fold the pieces of fabric and guide them into the dual needle area such that a double layer of the side fabric are sewn to each transverse side of the endless zipper chain.

Intermediate the sewing machine and the severing device is a deflecting roller which helps guide the sewn chain and side fabric to the severing device and prevents it from bulging upward and creating a blockage. The pressure on the roller is adjustable by spring biasing means.

Also intermediate the sewing machine and the severing device is a mirror mounted to allow the operator of the sewing machine to view the sewn product before it is severed and allow the operator to view the area and thereby control the time and location of the severing of the chain.

The severing device includes a pair of blades mounted on the substrate and constructed to allow the sewn chain to pass between the two blades. The bottom blade has a horizontal cutting edge and the upper blade has a diagonally extending cutting edge. Manual actuation of the cutting device by the operator propels the upper blade downward in close proximity to the bottom blade edge and thereby the endless zipper chain is severed to the length as desired by the sewing machine operator.

To prevent the operator or other workers from accidentally cutting themselves during the severing operation, the zipper is designed to slide between horizontal plates and the cutters are designed to be mounted in slots in those two horizontal plates, the upper reciprocating cutter will pass through both slots in its cutting operation while the bottom cutter will remain stationary in the slot in the lower plate.

The two parallel plates will receive the endless zipper chain and its sewn side pieces for easy passage delivered from the sewing machine and the two plates are vertically spaced to allow this easy passage. However, the plates are so structured as to have the spacing between the two of a dimension which will not allow workers to place their hands or fingers between the two plates to the extent that they can reach the two slots.

To further provide a safety feature, the upper reciprocating cutter is completely enclosed in a housing to prevent inadvertent accidents.

To allow the operator to see the location of the sewn zipper and side fabric in the cutting device, the upper of the two plates and the side walls of the housing around the upper cutting device are made of ¼ inch thick plexiglas. Thereby, the operator or other workers may see whether there is a malfunction within the cutting device whether it be crumpling of the zipper chain or some blade malfunction. It is not unusual in these operations for the zipper chain to be deflected or crumpled and stop its forward movement. Without the transparent plexiglas and the aforementioned mirror an operator on the inlet side of the sewing machine will continue to sew and add to the complication of unclogging the chain blockage within the cutting device. The plexiglas allows workers to see exactly what the problem is without having to disassemble the whole machine. Often the solution is to yank the chain from the upstream side to pull the lead end out of the cutter. Without transparent walls the workers cannot be confident in yanking the chain because it might be wedged and yanking could bend parts.

It has been discovered that plexiglas of less than ¼ inch in thickness does not have a long operating life. Forces exerted in yanking the chain tend to crack plexiglas of thinner construction.

Often it is necessary to work on the downstream side of the sewing machine or the upstream side of the severing device to return the combination to operable conditions and this is difficult because of the close proximity of the two main components. To solve this problem this invention mounts the severing device including the two plates, the cutters, and the upper cutter actuation piston on a horizontally mounted rod. Thereby, the whole cutting device can rotate, about a horizontal axis, away from the sewing machine to thereby expose the downstream side of the sewing machine and/or the upstream of the severing device to easy viewing and working by repair workers as necessary.

Downstream of the severing device is a deflecting shield mounted to direct the severed pieces of zipper to a storage location where they may be collected, stacked, and stored for subsequent use as needed.

Objects of the invention not clear from the above summary will be clear upon a review of the attached drawings and the description of the preferred embodiment which follows.

BRIEF DESCRIPTION OF THE DRAWINGS

FIG. 5 is a perspective view of the zipper and side piece guide for directing the zipper and side pieces to the dual needle sewing machine; and FIG. 6 is a sectional view taken along line 6—6 of FIG. 5.

DESCRIPTION OF THE PREFERRED EMBODIMENT

Figure 1:
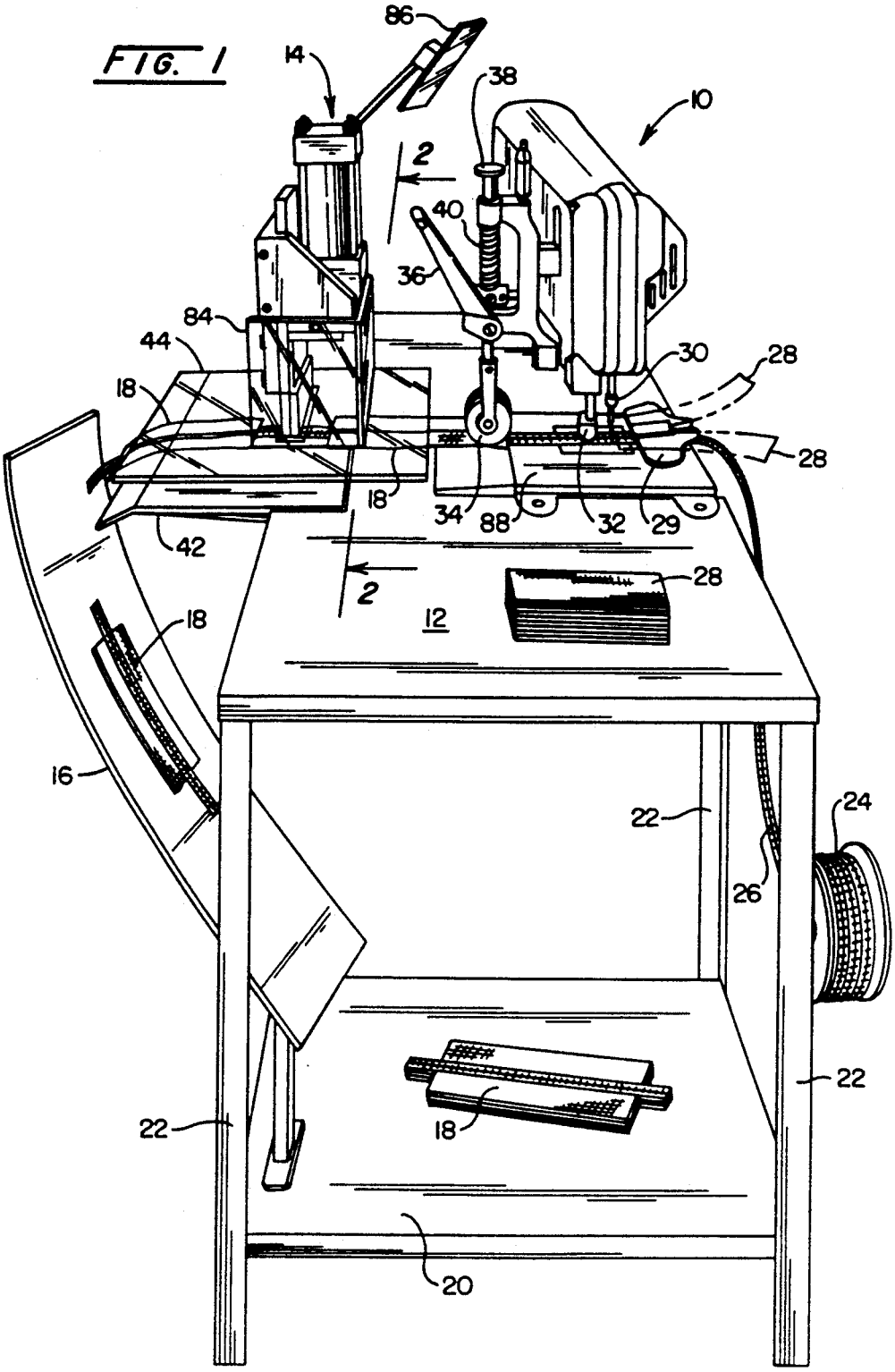
FIG. 1 is a perspective view of the combination of a sewing machine, severing device, and deflector to direct severed parts to a storage location.

Looking to FIG. 1, a sewing machine 10 is mounted on a substrate 12 upstream of a zipper severing device 14. Downstream of the severing 14 is a deflecting guide 16 to direct severed pieces 18 of zipper and side fabric to a storage location which in this case is a lower shelf 20 below substrate 12.

The substrate 12 and shelf 20 are supported by four legs 22 and on one of the legs is mounted a reel 24 of zipper chain 26 which will be sewn to a pair of side fabric pieces 28 (shown in phantom on the right-hand of FIG. 1).

A guide 29 upstream of the dual needle sewing machine 30 operates in conjunction with a pair of conventional presser feet 32 and together they join zipper 26 to a double layer of side piece fabric 28, one on each side of the zipper. The upstanding frame supporting the needles and presser feet is of conventional structure. As best seen in FIGS. 5 and 6, guide 29 includes a pair of U-shaped elements 31 looping around the ends of two spacers 33.

Downstream of the sewing machine 10 is a guide roller 34 which receives the sewn zipper and side fabric combination from the presser feet 32 and guides it into proper location in the zipper severing device. The guide roller is depressed into position by a cam lever 36 and the degree of pressure supplied by roller 34 is controlled by a thumb screw 38 which compresses or relieves a pressure spring 40.

Zipper severing device 14 includes a pair of parallel horizontal plates 42, 44 mounted in relation to the substrate 12 such that guide roller 34 guides the sewn zipper chain and side fabric pieces 18 between the two plates. The zipper and fabric slides along the upper surface of the lower plate 42 and the spacing 58 between it and the upper plate 44. The spacing 58 allows for the easy passage of the zipper but will be too narrow to allow an inadvertent hand or finger of a worker to pass between them.

Figure 2:
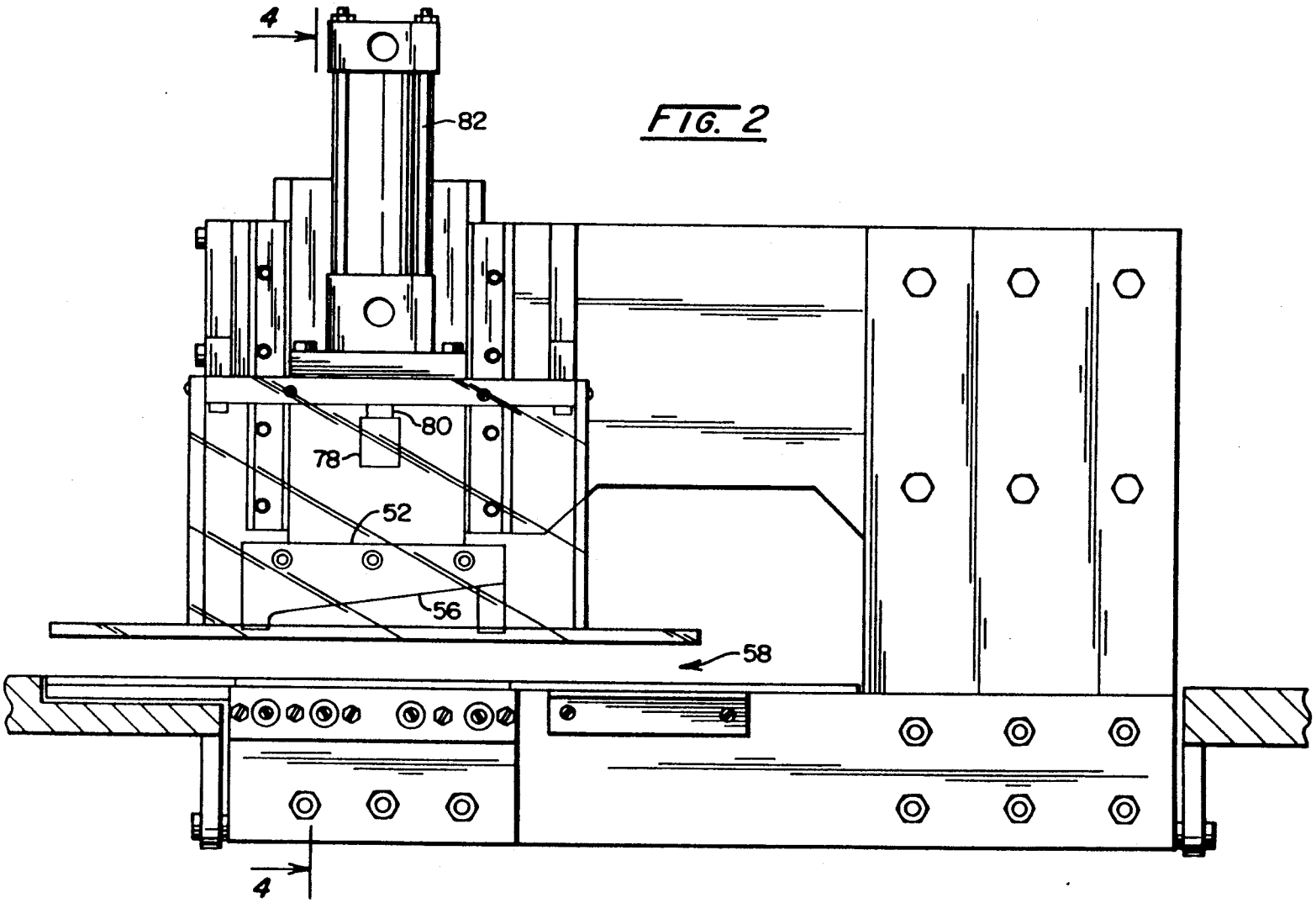
FIG. 2 is a sectional view of the severing device taken along line 2—2 of FIG. 1.
Figure 3:
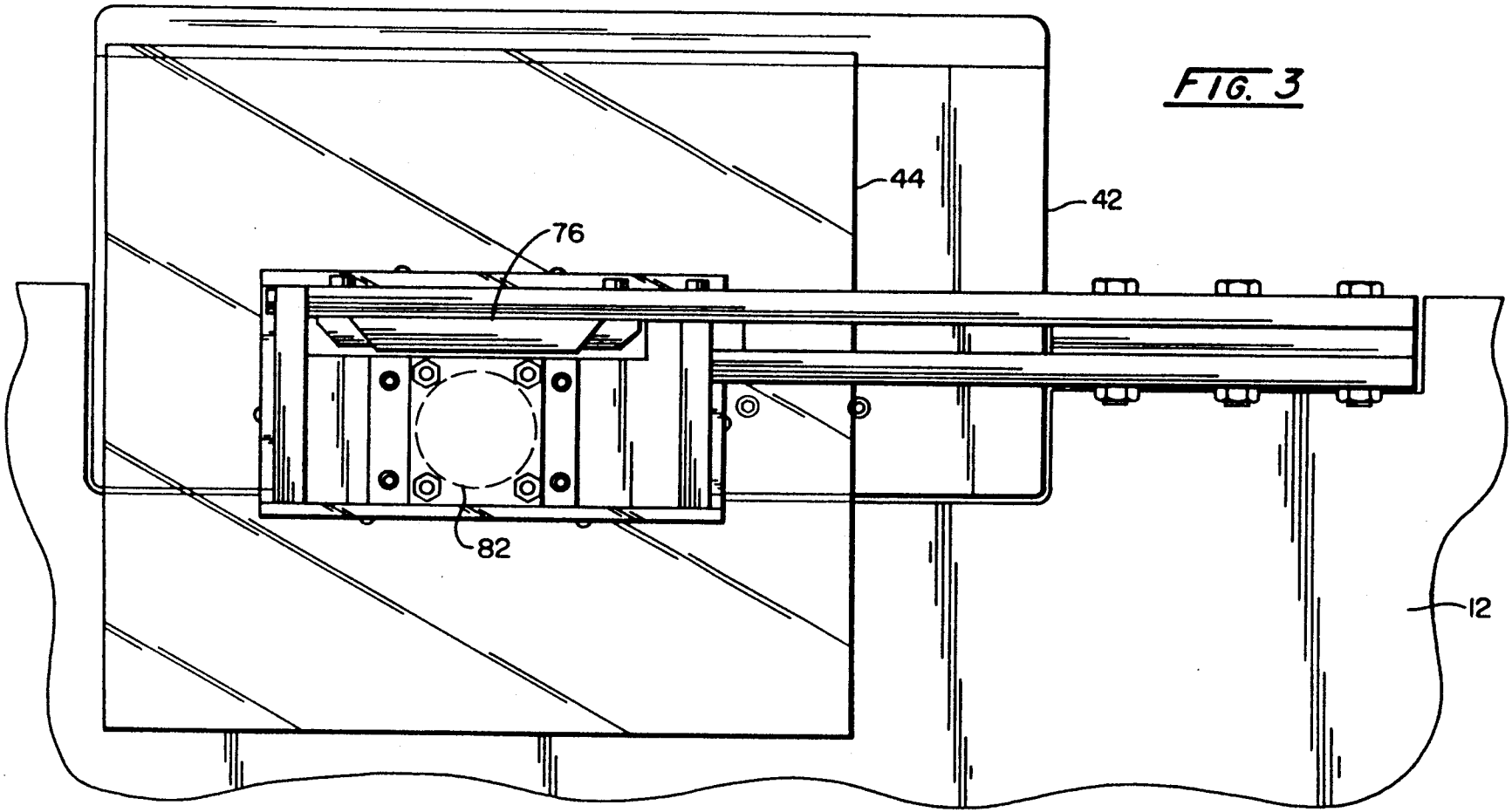
FIG. 3 is a top plan view of the severing device of FIG. 2.
Figure 4:
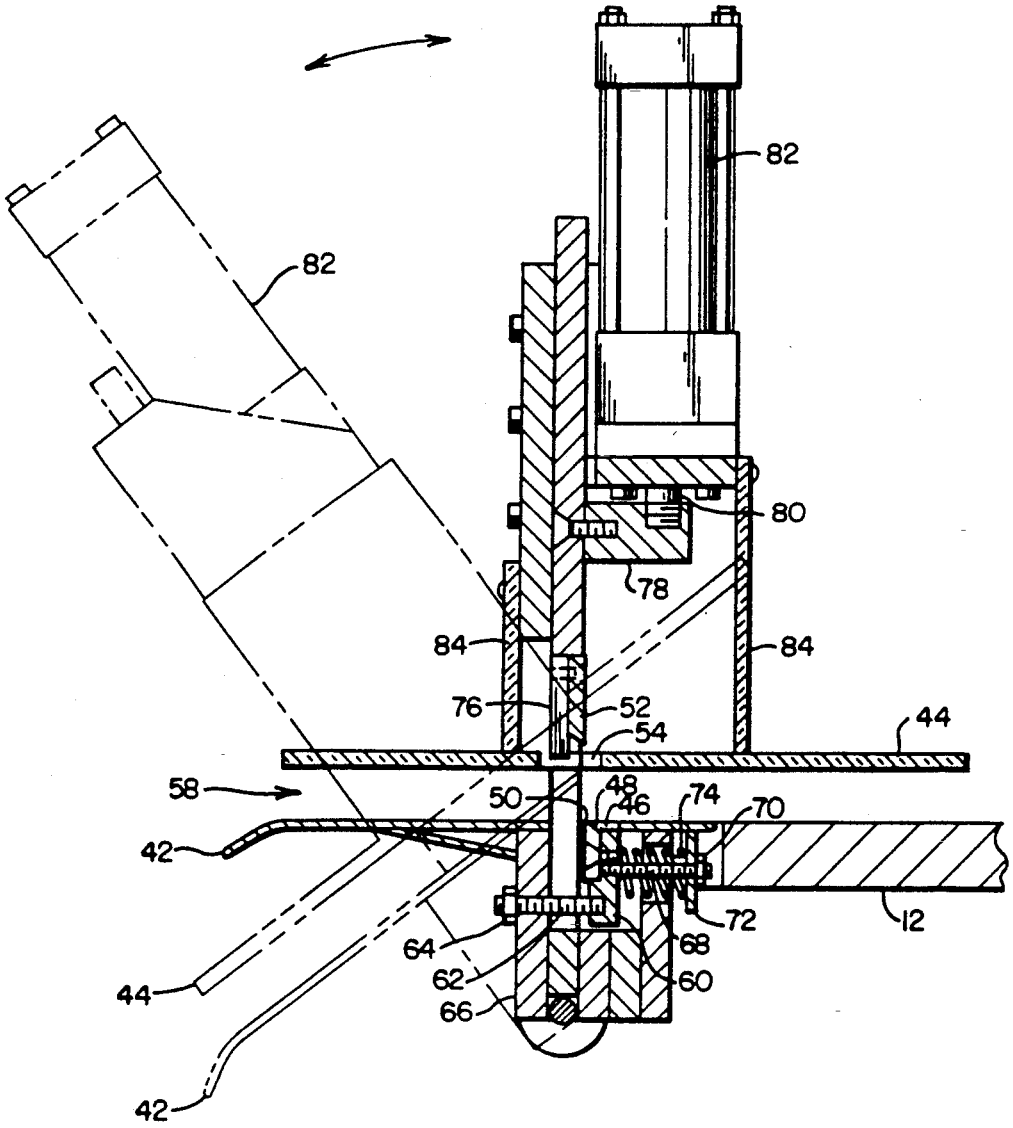
FIG. 4 is a sectional view taken along line 4—4 of FIG. 2 and including a phantom showing of the severing device partially rotated out of operable position.

As best seen in FIGS. 2 and 4, the upper and lower plates each have slots 46, 54 which are at least partially vertically aligned. The slot 46 in the lower plate 42 has a first cutter blade 48 mounted therein with the cutting edge 50 thereof being horizontal. It is constructed to operate with a second cutting blade 52 mounted above upper plate 44 and constructed to reciprocate through slot 54 and into slot 46 past lower cutting blade 48.

Observing FIG. 2, it will be noted that cutting edge 56 of second blade 52 extends angularly or diagonally rather than horizontally, thereby when the blade 56 is depressed during normal operations it cuts the zipper chain sequentially from one side to the other rather than an impact cutting operation which cuts simultaneously completely across the width of the chain. It has been found by experimental use that the diagonal cutting edge 56 causes less misalignment and clogging of the zipper in the space or duct 58 between the two plates than where the blade 52 includes a horizontal cutting edge.

Lower cutting blade 48 is adjustably mounted within the slot 46 to fine tune the adjustment of the cutting operation with the relatively rigid reciprocation path of second cutting blade 52. Blade 46 is mounted in a bracket 60 which is horizontally adjustable back and forth, as seen in FIG. 4, by a stud 62 and nut 64 which pass through bulkhead 66. Further adjustment of bracket 60 from the other direction is by a second stud 68 and second nut 70 extending through a flange 72. A spring biasing means 74 presses against flange 72 and bracket 60 to hold cutting blade 48 in place while allowing a certain amount of mechanical play in the connection to prevent bending or breaking of the cutters and their supporting structure upon slight misalignment of the blades or the zipper teeth.

The upper cutter blade 52 is mounted in a second bracket 76 which is mechanically connected to a block 78 secured to one end of a rod 80 of a piston and cylinder combination 82.

In order to allow workers to observe the cutting operation and any malfunction which may occur between plates 42 and 44 in space 58, the upper plate 44 is made of plexiglas at least ¼ inch thick. To allow adequate observation, the housing sidewalls 84 surrounding the upper cutter blade 52 are also of at least ¼ inch thick plexiglas. The sidewalls 84 completely enclose the reciprocating cutter 52 to prevent the inadvertent cutting injury to appendages of workers. The top of the housing is closed off by the mounting apparatus for the piston and cylinder combination 82 and the bracket 76.

A reflecting mirror 86 is aligned within the sight of the sewing machine operator to allow the operator to see the location of the zipper and fabric pieces 18 in the space between the pressing feet 32 and the second cutter 52. Thereby, the operator can control the time and place for severing the chain by manual actuation of a button, lever arm, or the like to initiate the reciprocation of the piston-cylinder combination 82 and cutter blade 52.

In operation, the sewing machine operator will slide the end of the zipper chain 26 through gap 87 under guide 29 and will manually insert fabric side pieces 28 in the U-shaped wing areas 31 of guide 29 before actuating the sewing machine 10. The U-shaped elements 31 direct the edges of fabric 28 around spacers 33 until they encounter abutments 89 which serve to stop sidewise movement. Actuation of the sewing machine is by a foot pedal or similar actuating mechanism and an automatically controlled advancing means (not shown) beneath the sewing machine base 88 urges the fabric and zipper through the dual needle 30 and presser foot 32 combination toward guide roller 34. Guide roller 34 directs the sewn pieces 18 between plates 42 and 44 while the operator observes the progress through reflecting mirror 86. The mirror allows the operator to remain in seated position while feeding the fabric side pieces 28 to the guide 29 even though the area between the sewing machine and cutting device is obscured from direct line of sight.

At such time as the zipper chain and sewn fabric pieces progress to a point between cutting blades 48 and 52 as is observed by the operator through the mirror, the operator actuates the cutting device by a manual operation (not shown) which opens cylinder 82 to air pressure (in this case about 110 psi) to depress a piston and rod 80. Upper blade 52 is thus directed downward through slots 54 and 46 to sever the zipper chain into a discrete unit 18.

After the severing operation takes place the operator again feeds side fabric pieces 28 through the guide 29 while actuating the sewing machine and as the severed end of the zipper chain progresses between plates 42 and 44 it pushes the previously severed piece out of gap 58. Severed piece 18 slides from the bottom plate 42 onto deflecting guide 16 into the storage area 20.

Having thus described the invention in its preferred embodiment, it will be clear to those having ordinary skill in the art that modifications may be made in the apparatus without departing from the spirit of the invention. Accordingly, it is not intended that the drawings, nor the language used herein to describe the invention, be limiting on the invention itself, rather it is intended that the invention be limited only by the scope of the appended claims.

We claim:

1. In combination, a sewing machine for sewing a zipper chain to side fabric and a severing device for severing the sewn zipper chain and fabric into discrete units for subsequent use, the combination comprising, said sewing machine including a base with an upstanding frame, said frame supporting a dual needle means for sewing said chain to said fabric, said base being mounted on a substrate, a guide mounted on said sewing machine for guiding said fabric to said dual needle means, fabric advancing means associated with said sewing machine for advancing fabric from the guide through said needle means, one end of a zipper chain being disposed to slide beneath said guide, said guide being mounted on a base of said sewing machine upstream of pressing shoes and said dual sewing needles of the sewing machine, said guide being configured to receive manually inserted side fabric above and laterally to each side of the zipper chain and guide said fabric and chain beneath said pressing shoes and toward said needles, said zipper and fabric moving in a stream from said guide through said needle means to said severing device, said severing device being mounted on said substrate aligned with said guide and needle means and downstream of said needle means, said severing device including a duct formed by two spaced apart planar plates, the lower of said planer plates supporting the sewn zipper and fabric dispensed by said sewing machine, each said plate including a slot, said slots being vertically aligned, a first cutter blade having a horizontal cutting edge being mounted in the slot of the lower plate, said cutting edge facing toward the upper of said plates, a second cutter blade being mounted above the slot in said upper plate, said second cutter blade having an angularly extending cutting edge, means for vertically reciprocating said second cutter blade through said slots to cooperate with said first cutter blade to sever the sewn zipper and fabric into discrete units, means to prevent accidental insertion of worker's hands between said blades during zipper severing operations while simultaneously allowing complete visual observation of the severing operation, said accident preventing means including a plexiglas housing, said plexiglas housing including said upper plate as the bottom of said housing, said upper plate being joined to vertical sidewalls which are closed at their upper end by a cap, the vertical spacing between said two plates being great enough to allow the unobstructed passage of the sewn zipper and fabric but small enough to prevent the insertion of worker's hands from the edges of the plates to the slots.

2. The combination of claim including means for displaying a view of the severing device and the sewn zipper to a worker feeding the fabric pieces to the sewing machine while the severing device is operating to allow the worker to manually control the actuation of the severing device.

3. The combination of claim 2 wherein the displaying means comprises a reflecting mirror mounted to allow the worker to see the sewn zipper between the severing device and the sewing machine without moving from the worker's position for inserting the fabric pieces.

4. The combination of claim 3 including deflecting means downstream of said severing device for directing severed pieces of zipper and fabric to a storage location.

5. The combination of claim 4 wherein the means for vertically reciprocating said second blade comprises a piston and cylinder with said second blade being mechanically connected to said piston.

6. The combination of claim 5 wherein the severing device, including the two plates, blades and housing, is mounted on a horizontal rod which in turn is mechanically connected to said substrate, said mechanical connection allowing the rod to rotate in a horizontal plane and thereby rotate the severing device out of the way to allow service and repair of the sewing machine from the downstream side without disassembling the severing device.

7. The combination of claim 6 including means for adjusting the first blade horizontally with respect to said second blade.

8. The combination of claim 7 including spring biasing means engaging said first cutter to allow some play in its orientation to prevent cutter damage due to misalignment.

9. The combination of claim 8 wherein the plexiglas housing surrounds said second blade and the means for reciprocating said second blade.

10. The combination of claim 9 including means for preventing an upward deflection of the sewn fabric and zipper in the space intermediate the sewing machine and the severing device.

11. The combination of claim 1 including spring biasing means engaging said first cutter to allow some play in its orientation to prevent cutter damage due to misalignment.

12. The combination of claim 1 including means for adjusting the first blade horizontally with respect to said second blade.

* * * * *